US005391056A

United States Patent [19]

Wang

[11] Patent Number: 5,391,056

[45] **Date of Patent: * Feb. 21, 1995**

[54] TRI-POD PORTABLE FAN

[75] Inventor: Jui-Shang Wang, Taipei,

[73] Assignee: Duracraft Corporation, Whitinsville, Mass.

[ * ] Notice: The portion of the term of this patent subsequent to Apr. 19, 2011 has been disclaimed.

[21] Appl. No.: 143,408

[22] Filed: Oct. 26, 1993

Related U.S. Application Data

[63] Continuation of Ser. No. 726,676, Jul. 8, 1991, Pat. No. 5,304,040.

[51] Int. Cl.[6] ..... F04D 29/70

[52] U.S. Cl. ..... 416/247 R; 416/246

[58] Field of Search ..... 416/247 R, 246

[56] References Cited

U.S. PATENT DOCUMENTS

| | | | |
|---|---|---|---|
| 2,281,769 | 5/1942 | Hochriem | 248/188.2 |
| 2,476,692 | 7/1949 | Bernstein | 416/246 |
| 2,544,281 | 3/1951 | Seil | 416/247 |
| 2,600,325 | 6/1952 | Reisch | 416/100 |
| 2,857,095 | 10/1958 | Suarez et al. | 416/246 |
| 3,927,853 | 12/1975 | Guth | 248/188.2 |
| 4,925,137 | 5/1990 | Hastings | 248/188.2 |
| 4,927,324 | 5/1990 | Coup et al. | 416/247 |
| 5,131,810 | 7/1992 | Wang | 416/247 R |

FOREIGN PATENT DOCUMENTS

| | | | |
|---|---|---|---|
| 232110 | 1/1961 | Australia | 416/247 R |
| 447853 | 7/1927 | Germany | 416/247 |
| 648604 | 8/1937 | Germany | 416/247 |
| 606288 | 7/1960 | Italy | 416/246 |
| 135792 | 10/1981 | Japan | 416/247 R |
| 68595 | 4/1982 | Japan | 416/100 |
| 179523 | 11/1982 | Japan | 416/247 R |
| 210291 | 9/1987 | Japan | 416/246 |
| 80509 | 9/1918 | Switzerland | 248/188.2 |
| 518642 | 3/1940 | United Kingdom | 248/188.2 |

*Primary Examiner*—John T. Kwon
*Attorney, Agent, or Firm*—Pennie & Edmonds

[57] ABSTRACT

An air blower including a rear housing defining a plurality of air inlet openings, a front housing having an annular peripheral portion secured to the rear housing, a central support portion within the peripheral portion, a grillwork portion extending between the peripheral portion and the support portion, and a fan assembly secured to the central portion and projecting toward the rear housing. The grillwork portion includes a plurality of vanes each of which is arcuately curved in shape and each of which is connected between the central support portion and the annular peripheral portion independently of the other.

11 Claims, 2 Drawing Sheets

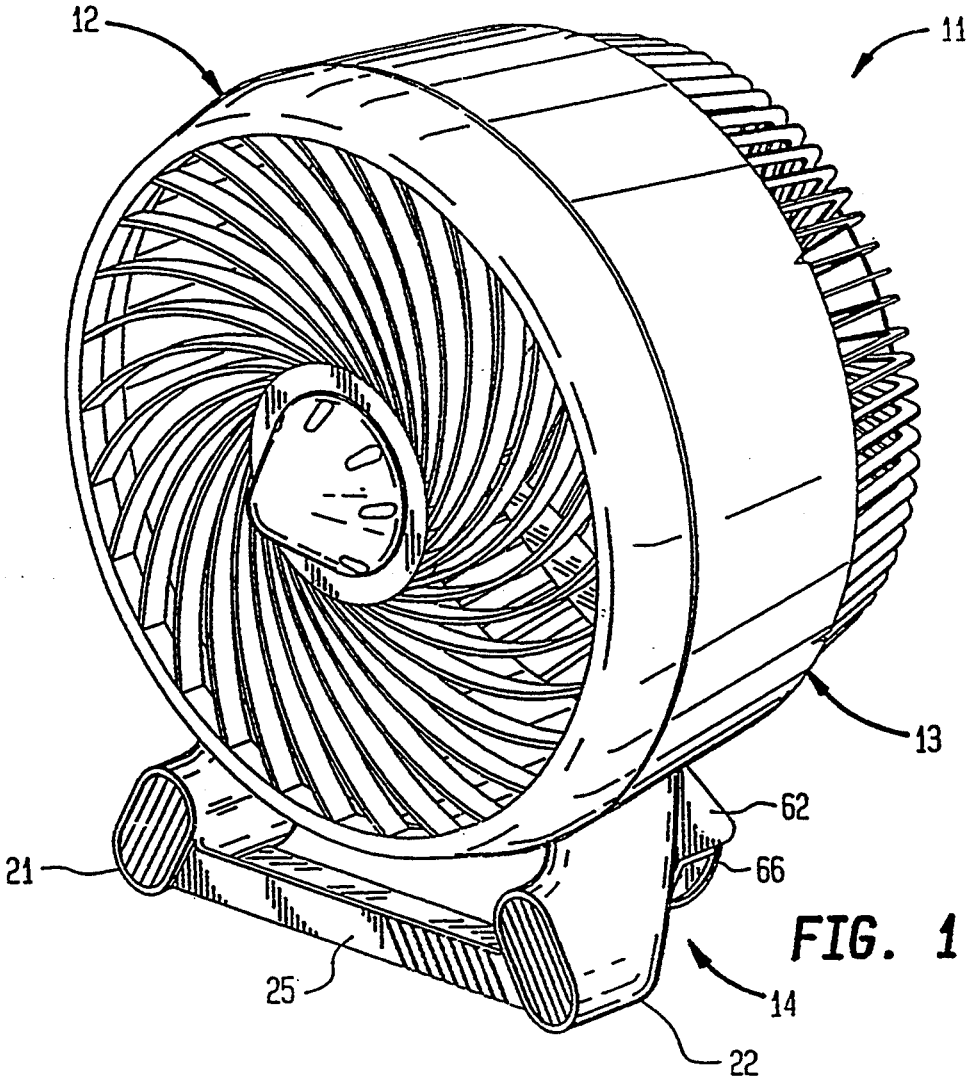
FIG. 1
FIG. 4
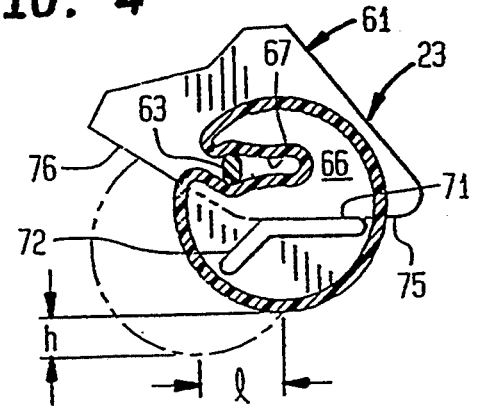

TRI-POD PORTABLE FAN

This is a continuation of application Ser. No. 07/726,676, filed Jul. 8, 1991, U.S. Pat. No. 5,304,040.

BACKGROUND OF THE INVENTION

This invention relates generally to a portable electrical fan and, more particularly, to a versatile, easily manufactured, and low cost portable electrical fan.

Portable electrical fans are utilized to create air flow and thereby enhance environmental conditions. To optimize the flow patterns produced thereby, many portable fans are provided with supports that permit selective orientation of a fan member on a supporting pedestal. Although various types of fan supports have been proposed, prior support mechanisms suffer from a number of individual and collective disadvantages such as high cost, cumbersome adjustment requirements, excessive size, insufficient orientation adjustment capability, etc.

The object of this invention, therefore, is to provide an improved portable electrical fan that is inexpensive, easily assembled, and can be easily transported to a position and adjusted to provide a desired air flow orientation.

SUMMARY OF THE INVENTION

The invention is an air blower including a rear housing defining a plurality of air inlet openings; a front housing having an annular peripheral portion secured to the rear housing, a central support portion within the peripheral portion and including a rear surface facing the rear housing and an oppositely directed front surface, and a grillwork portion extending between the peripheral portion and the support portion; and a fan assembly secured to the rear surface and projecting toward the rear housing, the fan assembly including an electrical motor and a fan blade rotatably coupled therewith, an electrical switch operatively connected to the motor, and an actuator operatively coupled to the electrical switch and projecting outwardly from the front surface. Mounting of the fan assembly on the central support portion simplifies assembly and minimizes external size of the blower.

According to features of the invention, the rear housing further defines a chamber, a substantially circular access opening thereto, the fan assembly projects through the access opening into the chamber, the peripheral portion includes a substantially circular rim engaging the access opening which is covered by the front housing. This arrangement further optimizes the external configuration of the blower.

According to another feature of the invention, the grillwork portion comprises a plurality of curved vanes extending between the rim and the central support portion. The curved vanes enhance the selection of a desired air discharge pattern.

According to other features of the invention, the front housing and the rear housing are integrally molded units. These features reduce cost and further simplify assembly of the blower.

According to another feature, the invention includes a power cord connected to the electrical switch and the front housing means further defines a channel opening toward the chamber and retaining a portion of a power cord connected to the switch. The channel provides a conveniently located protective housing for the power cord.

According to yet other features, the blower further comprises a base including a downwardly projecting handle and adapted to support the blower on a support surface. Combining a base and downwardly projecting handle enhances the compact external configuration of the blower.

According to other features of the invention, the base comprises only three legs, one of the legs is disposed in a plane bisecting the other two legs, a cross member extending between the other two legs forms the handle, and the blower includes an orientation adjustment mechanism for the one leg. The adjustment mechanism permits selective changes in the orientation of the blower to establish desired air discharge patterns.

According to further features of the invention, the adjustment mechanism is operable to change the length of the one leg, and the spacing between the one leg and the other two legs. This arrangement facilitates the selective orientation of the blower.

According to additional features of the invention, the one leg comprises a pair of spaced apart brackets retaining a pivot pin, and the adjustment mechanism comprises a rotary member disposed between the brackets, having an eccentric hole rotatably coupled to the pivot pin and adapted to engage the support surface, and defining rotation limiting stop surfaces for engaging the brackets to limit rotation of the rotary member on the pivot pin. Selective orientation of the blower is provided by rotation of the rotary member between the limits established by the stop surfaces.

DESCRIPTION OF THE DRAWINGS

These and other objects and features of the invention will become more apparent upon a perusal of the following description taken in conjunction with the accompanying drawings wherein:

FIG. 1 is a perspective view of a portable fan according to the invention;

FIG. 4 is a partial cross-sectional view showing an adjustable leg on the fan shown in FIGS. 1–3.

DESCRIPTION OF THE PREFERRED EMBODIMENT

Figure 2:
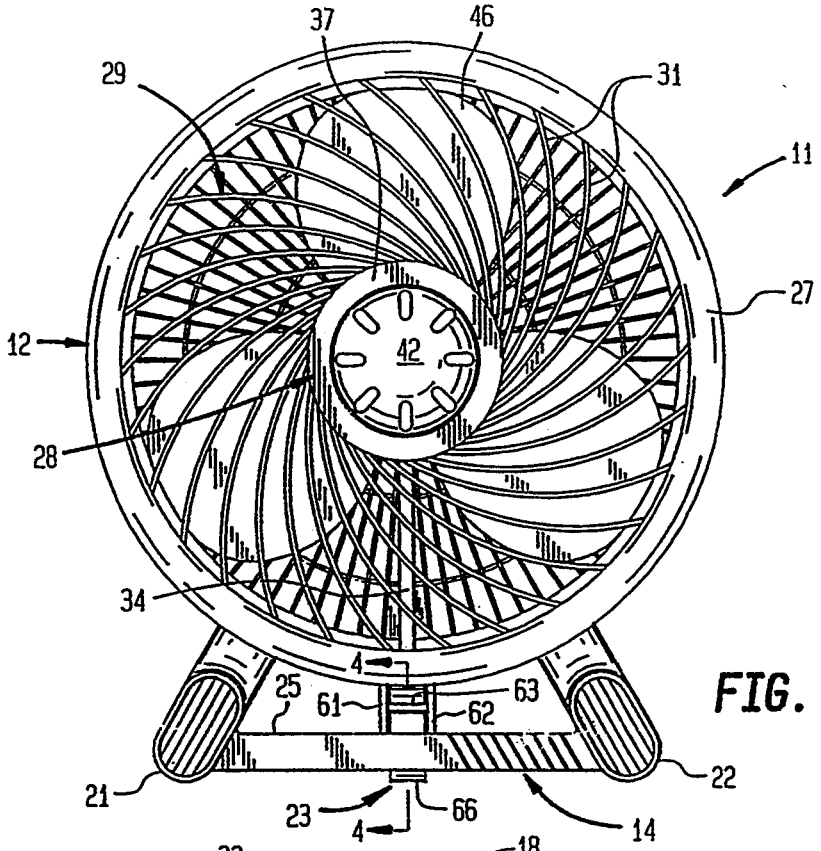
FIG. 2 is a front view of the fan shown in FIG. 1.

An air blower 11 according to the present invention includes a front housing 12, a rear housing 13 and base 14. The rear housing 13 defines a chamber 16 and a plurality of rearwardly facing first air passage in the form of inlet openings 17. Also defined by the rear housing 13 is a circular opening 18 providing access to the chamber 16.

The base 14 includes a pair of front legs 21, 22 projecting downwardly from a front portion of the rear housing 13 and a rear leg 23 projecting downwardly from a rear portion thereof. Extending between the front legs 21, 22 is a cross member 25 that is spaced from the front housing 12 and the rear housing 13 so as to form a handle for the blower 11. The rear leg 23 is spaced rearwardly from the front legs 21, 22 and disposed in a bisecting plane therebetween. Thus, the front legs 21, 22 and the rear leg 23 form a tri-pod for supporting the blower 11 on a suitable support surface (not shown). Preferably, the rear housing 13 and the base 14 are formed as an integrally molded unit.

The front housing 12 includes an annular peripheral rim portion 27, conforming to the circular access opening 18 in the rear housing 13, a centrally located central support portion 28 and a grillwork portion 29 extending therebetween and defining a plurality of second air passages extending between the annular or peripheral portion 27 and the central portion 28. Forming the grillwork portion 29 are a plurality of curved vanes 31 having opposite ends attached, respectively, to the rim portion 27 and the central support portion 28. More particularly, the vanes each includes a first end connected to the central support portion and a second end connected to the annular peripheral portion. The vanes are connected between the central support portion and the peripheral portion independently of each other. As clearly shown in FIG. 2, the vanes are all curved in the same direction and equally spaced from each other, with the spacing at the first ends being smaller than the spacing at the second ends. As also seen from FIG. 2, the central portion is circular in shape. In addition, the first ends of the vanes are connected at circumferentially spaced points around the central portion whereby the second end of any vane is connected to the peripheral portion approximately at the location of the intersection of a line drawn tangent to the central portion at the point where the first end of that vane is connected to the central portion.

Figure 3:
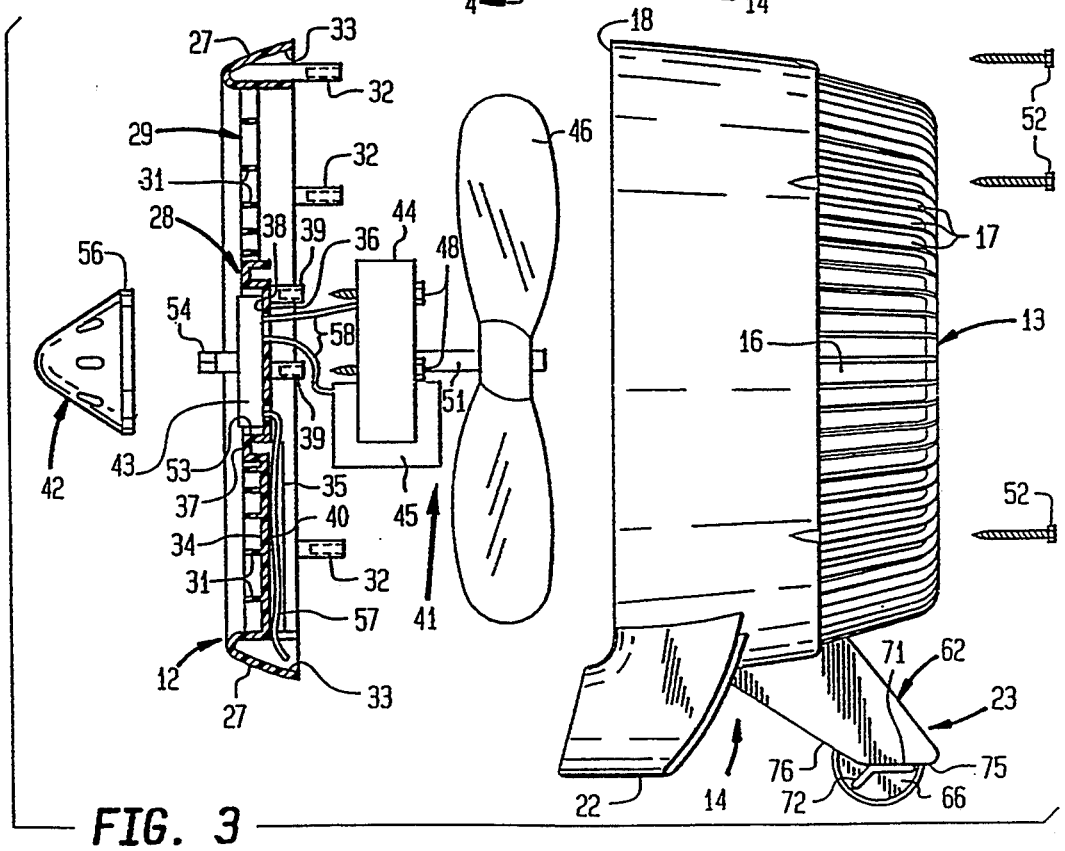
FIG. 3 is an exploded view, partially in section of the portable fan shown in FIGS. 1 and 2.

As shown in FIGS. 1 and 3, the vanes each have a rectangular cross-sectional shape defining opposite flat surfaces facing toward the peripheral and support portions of the front housing. The flat portions of the vanes are connected together by opposite edges of the vanes. As shown in FIGS. 1 and 2, the width of the edges is less than the width of the flat surfaces of the vanes. Also, the vanes are completely disposed in a flat plane extending substantially perpendicular to the axis of rotation of the fan. A plurality of internally threaded studs 32 project rearwardly from a trough 33 formed by the rim portion 27 as shown in FIG. 3. Also formed by the front housing 12 are a front wall 34 and side walls 35 that extend between the central support portion 28 and the trough 33 so as to form a rearwardly opening channel 40. The central support portion 28 includes a rear surface 36 facing the rear housing 13 and an oppositely directed front surface 37. Formed by the front surface 37 is a circular cavity 38. A plurality of internally threaded studs 39 extend rearwardly from the rear surface 36. Preferably, the front housing 12 also is formed as an integrally molded unit.

A fan assembly 41 (FIG. 3) is supported by the central support portion 28 of the front housing 12. Included in the fan assembly 41 is an actuator knob 42, a conventional electrical rotary switch 43, an electrical motor 44, a tranformer 45 and a fan blade 46. The transformer 45 is attached to the electrical motor 44 and that unit is secured by screws 48 to the rearwardly projecting studs 39 on the central support portion 28. A drive shaft 51 rotatably couples the motor 44 to the fan blade 46 which projects into the chamber 16 formed by the rear housing 13. Securing the rear housing 13 to the front housing 12 are a plurality of screws 52 which engage the internally threaded studs 32. With this mounting of the fan, the curved vanes will inherently absorb torque created by the fan as it is rotated about the axis of the shaft 51.

The electrical switch 43 is retained within the cavity 38 in the central support portion 28 and defines therewith an annular recess 53. Projecting forwardly from the electrical switch 43 is an actuator shaft 54. Keyed for rotation with the actuator shaft 54 is the actuator knob 42 which projects forwardly from the central support portion 28 of the front housing 12. A rearwardly extending circular flange portion 56 of the actuator knob 42 is received by the annular recess 53 formed between the central support portion 28 and the electrical switch 43. Connected to the electrical switch 43 and extending through the channel 40 is a power cord 57. A plurality of electrical wires 58 connect the electrical switch 43 to the motor 44 and the transformer 45.

The rear leg 23 is formed by a pair of spaced apart brackets 61, 62 that project downwardly from the rear portion of the rear housing 13. Extending between the brackets 61, 62 is an elliptically shaped pivot pin 63. Retained by the pivot pin 63 between the brackets 61, 62 is a rotatable, circular disk member 66. As shown in FIG. 4, the disk member 66 defines an eccentric hole 67 that accommodates the pivot pin 63. Projecting transversely from opposite sides of the disk member are a first pair of ridges 71. Also projecting transversely from opposite sides of the disk member 66 and intercepting the first ridges 71 are a second pair of ridges 72. Rotation of the disk member 66 on the pivot pin 63 in one sense is limited by engagement between the stop surfaces formed by the first ridges 71 and first stop surfaces formed by bottom edges 75 of the brackets 61, 62. Similarly, rotation of the disk member 66 in the opposite sense is limited by engagement between the stop surfaces formed by the second ridges 72 and second stop surfaces formed by the forwardly facing edges 76 of the brackets 61, 62.

OPERATION

During use, the air blower 11 is easily transported to a location in which air circulation is desired. Transportation is accomplished by merely gripping the cross member handle 25 and moving the air blower 11 to the desired location. Once a suitable position is attained, the readily accessible actuator knob 42 can be rotated to actuate the switch 43 and energize the electrical motor 44, thereby producing rotation of the fan blade 46. That rotation draws air inwardly through the inlet openings 17 in the rear housing 13 for discharge through the grillwork 29 in the front housing 12. As air is discharged through the grillwork 29, aerodynamic flow is enhanced by the conical shape of the actuator knob 42 with its outwardly facing apex.

When in an established position, vertical orientation of air flow produced by the blower 11 can be adjusted easily by rotation of the disk member 66 on the pivot pin 63. As the disk member 66 is rotated on the pin 63 between the position shown by solid lines in FIG. 4 with the first ridges 71 engaging the bottom edges 75 of the brackets 61, 62 to the position shown by dashed lines with the second ridges 72 engaging the front edges 76 of the brackets 61, 62; the effective length of the rear leg 23 is changed by a distance h and the spacing thereof from the front legs 21, 22 is changed by a distance 1. Consequently, the tilt of the air blower 11 is changed and the orientation of air flow produced thereby is altered accordingly. Frictional engagement between the eccentric hole 67 in the disk member 66 and the pivot pin 63 will retain the disk member 66 in any desired angular position between those illustrated in FIG. 4 to thereby establish any of a variety of desired orientations for the blower 11.

Obviously, many modifications and variations of the present invention are possible in light of the above teachings. It is to be understood, therefore, that the invention can be practiced otherwise than as specifically described.

What is claimed is:

1. An air blower comprising:

a) first housing means defining a plurality of first air passages;

b) second housing means secured to said first housing means and having a central portion, an annular portion disposed radially outwardly of said central portion, and a grillwork portion forming second air passages extending between said annular portion and said central portion, wherein said first air passages and said second air passages are aligned axially;

c) a fan assembly secured to said central portion, said fan assembly comprising an electrical motor and a fan blade rotatably coupled therewith for rotation about an axis;

d) said grillwork portion comprising a plurality of vanes, each of which has a curved shape for absorbing torque created by rotation of said fan, said curved shape extending between opposite first and second ends of the vane; and e) said vanes being connected between said central portion and said annular portion with said first end of each vane being connected to said central portion and said second end of each vane being connected to said annular portion.

2. An air blower comprising:

a) first housing means defining a plurality of first air passages;

b) second housing means secured to said first housing means and having an annular peripheral portion, a central support portion within said peripheral portion, and a grillwork portion forming second air passages extending between said peripheral portion and said central support portion, wherein said first air passages and said second air passages are aligned axially;

c) a fan assembly secured to said central support portion, said fan assembly comprising an electrical motor and a fan blade rotatably coupled therewith for rotation about an axis;

d) said grillwork portion comprising a plurality of vanes, each of which has a curved shape for absorbing torque created by rotation of said fan, said curved shape extending between opposite first and second ends of the vane; and e) said vanes being connected between said central support portion and said annular peripheral portion with said first end of each vane being connected to said central support portion and said second end of each vane being connected to said annular peripheral portion.

3. An air blower according to claim 2 wherein:

a) said first housing means is a rear housing means;

b) said first air passages are air inlet openings;

c) said second housing means is a front housing means;

d) said second air passages are air discharge openings; and e) said fan assembly is secured to said central support portion and projects toward said rear housing means.

4. An air blower according to claim 3 wherein:

said vanes are all arcuately curved in the same direction.

5. An air blower according to claim 4 wherein:

said vanes are equally spaced from each other with the spacing at the first ends being smaller than the spacing at the second ends.

6. An air blower according to claim 4 wherein:

a) said central portion is circular in shape and the first ends of said vanes are connected at circumferentially spaced points around said central portion; and b) any vane with its first end connected to a point on the central support portion has its second end connected to said annular peripheral portion approximately at the location of the intersection of a line drawn tangent to said central support portion at said point.

7. An air blower according to claim 6 wherein:

a) each of the vanes has a rectangular cross-sectional shape defining opposite flat surfaces of a predetermined width connected together by opposite edges of a width which is less than said predetermined width; and b) said vanes extend between said annular peripheral portion and said central support portion with said opposite flat surfaces facing toward said annular peripheral and central support portions.

8. An air blower according to claim 6 wherein:

the vanes of said grillwork are completely disposed in a flat plane extending substantially perpendicular to the axis of rotation of said fan.

9. An air blower according to any one of claims 3–8 wherein:

said front housing means is an integrally molded unit.

10. An air blower according to claim 3 wherein:

said fan assembly further includes an electrical switch operatively connected to said motor, and an actuator operatively mounted on the central support portion of said front housing means and coupled to said electrical switch, said actuator projecting outwardly of the front housing means in a direction away from said rear housing means.

11. An air blower according to claim 10 wherein:

said actuator is a conically shaped knob having an apex projecting outwardly of the front housing means in a direction away for said rear housing means.

* * * * *